United States Patent [19]

Beisel

[11] Patent Number: 4,505,196

[45] Date of Patent: Mar. 19, 1985

[54] SONIC SEED DEHULLING SYSTEM

[76] Inventor: Victor A. Beisel, Rte. 1, Box 26, Fargo, Okla. 73840

[21] Appl. No.: 594,378

[22] Filed: Mar. 28, 1984

[51] Int. Cl.[3] ..... B02B 3/00

[52] U.S. Cl. ..... 99/519; 99/518; 99/527; 209/144; 241/7; 241/39; 241/275

[58] Field of Search ..... 99/516, 534, 518, 519, 99/527, 524, 525, 528, 529, 568–570, 600–602, 609, 611, 623, 527, 451, 475; 241/5, 7, 39, 275; 426/481–483; 209/136, 139 R, 135, 141–144, 148, 149; 55/352, 456, 315

[56] References Cited

U.S. PATENT DOCUMENTS

| | | | |
|---|---|---|---|
| 1,595,257 | 8/1926 | Stebbins | 209/144 |
| 2,759,511 | 8/1956 | Jacobsen | 99/519 |
| 2,929,501 | 3/1960 | Fenske et al. | 209/144 |
| 3,301,292 | 1/1967 | O'Connor | 99/527 X |
| 3,561,515 | 2/1971 | Nahm | 99/519 |
| 3,595,486 | 7/1971 | Stephanoff | 241/5 |
| 3,648,745 | 3/1972 | Stamatiou | 99/519 |

*Primary Examiner*—Timothy F. Simone

*Attorney, Agent, or Firm*—Harvey B. Jacobson

[57] ABSTRACT

A batch seed dehuller for seed testing purposes is provided and includes an upright cylindrical chamber merging downwardly into the upper major diameter end of an inverted frusto-conical chamber which in turn merges downwardly into a downwardly opening generally cylindrical passage of smaller diameter than the cylindrical chamber. An annular top wall closes the outer peripheral portion of the upper end of the cylindrical chamber and includes an inner periphery downwardly from which a tubular vortex finder extends to a level spaced above the frusto-conical chamber. The cylindrical passage includes a small diameter generally radially inwardly opening compressed air inlet intermediate the upper and lower ends thereof and a lateral airflow outlet of greater cross-sectional area than the inlet opening generally radially outwardly of the cylindrical passage substantially diametrically opposite the inlet. The cylindrical chamber includes a substantially tangential air inlet closely beneath the top wall and a tubular passage communicates the lateral airflow outlet with the tangential inlet.

8 Claims, 4 Drawing Figures

26
2
12
10
56
16
58
42
36
46
38
62
20
64
60
2

26
24
56
10
30
14
28
12
58
18
16
36
40
44
32
54
46
42
38
34
52
22
20
64

48
20
32

36
22
50

16
28
10
22
36
54
20
12
56

SONIC SEED DEHULLING SYSTEM

BACKGROUND OF THE INVENTION

Various different grasses as well as grain crops are grown primarily for seeds and the value of such crops is determined upon the purity and germination factor of the harvested seed. The various different seeds are of course processed by various means preparatory to being sown and various different methods are used in testing the purity and germination factor of seeds in order to establish the price of a pound of seed which is paid to the seed grower.

At present the seed testing processes being used by various certified seed testing laboratories are at best only slightly consistent in that the percent pure seed reported by different laboratories on the same seed lot may vary a substantial amount and a seed grower may be paid only a fraction of the actual value of his crop as a result of an inaccurate seed testing process.

Further, seed processing plants utilize variously controllable equipment in processing seeds and changes in equipment operating controls during a seed processing run can greatly alter the seed purity and germination factor of processed seed. However, present seed testing apparatus and methods are so time-consuming as to substantially prevent any control changes of seed processing equipment during a particular seed processing run.

In addition, the actual condition of the seed at the time it is reaped can greatly affect the ultimate purity and germination factor of the seed after it has been processed. Here again, the present state of the seed testing art involves so much time as to prevent a seed grower from testing various areas of his seed crop immediately before the reaping of his crop in order to obtain the best possible seed from the field.

Accordingly, a need exists for a seed testing apparatus which will enable various seed lots to be rapidly, consistently and accurately tested for seed purity and germination factor. Not only will such an improved seed testing apparatus substantially reduce the cost of seed testing, but the increased rapidity in which seed lots may be tested will enable seed processing plants to test seed being processed during a seed processing run in order that various control changes of the process machinery may be made in order to improve the processing of that seed lot. In addition, increased rapidity and accuracy of such seed testing will enable seed farmers to test their seed in the field and to thereby reap their seed crop at the precise time which will afford them the maximum desirable quality seed.

Various different forms of classifying systems including some of the general structural and operational features of the instant invention are disclosed in U.S. Pat. Nos. 1,595,257, 1,861,247, 2,774,476, 2,939,579, 3,384,238, 3,620,370, 3,883,423 and 4,342,897. However, these previously known structures are not specifically designed to dehull and enable rapid testing of seed.

BRIEF DESCRIPTION OF THE INVENTION

The seed dehulling system of the instant invention incorporates a cyclone separator which is capable not only of batch dehulling and separating seeds from chaff, but which may be effectively modified to accomplish a seed hulling operation on a substantially continuous production basis. The seed dehuller has been specifically designed for testing a five gram sample of seed, but can be constructed of larger proportions and modified for production seeding dehulling purposes.

The dehuller is operative, during a five to ten second period of operation, to substantially completely dehull the seeds of a five gram sample and to thereafter separate the dehulled seed from the chaff and other lighter trash in an extremely efficient manner whereby manual separation of the chaff and seed is no longer required and the number of pure seed, the weight of the pure seed and the germination factor of the processed pure seed may be readily determined.

The main object of this invention is to provide an apparatus by which a batch seed sample may be rapidly and efficiently dehulled.

Yet another object of this invention is to provide a seed dehuller which will also function to enable the operator of the seed dehuller to quickly separately obtain all of the dehulled seed and the chaff and other trash of a seed test sample.

Yet another object of this invention is to provide a seed dehuller which may be modified for commercial seed dehulling operations.

Yet another object of this invention is to provide a seed dehuller for test samples which may be used not only in a seed testing laboratory, but which may also be used in a seed processing plant as well as in the field in order to test seed before and even during seed reaping operations.

A final object of this invention to be specifically enumerated herein is to provide a seed dehulling apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
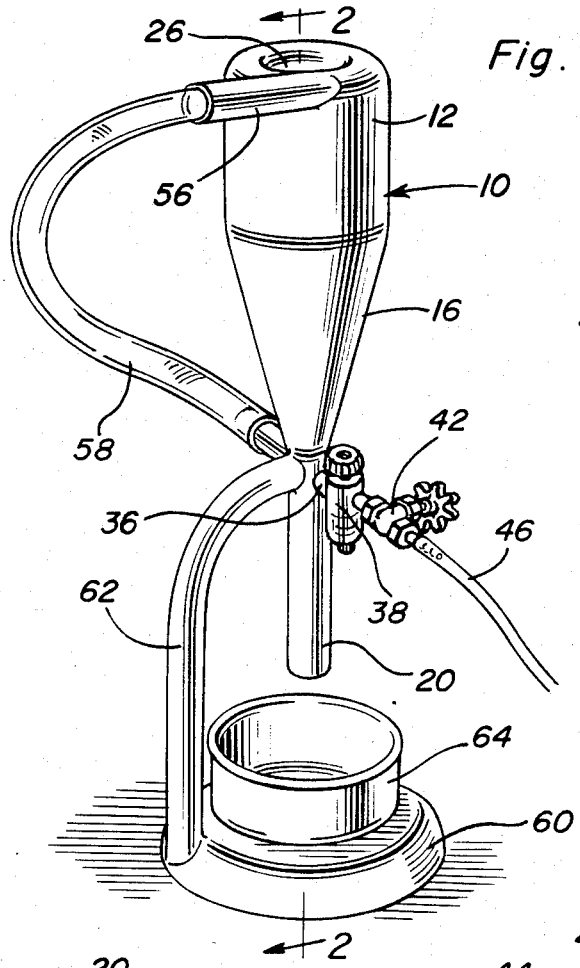
FIG. 1 is a perspective view of the seed dehulling apparatus of the instant invention.
Figure 2:
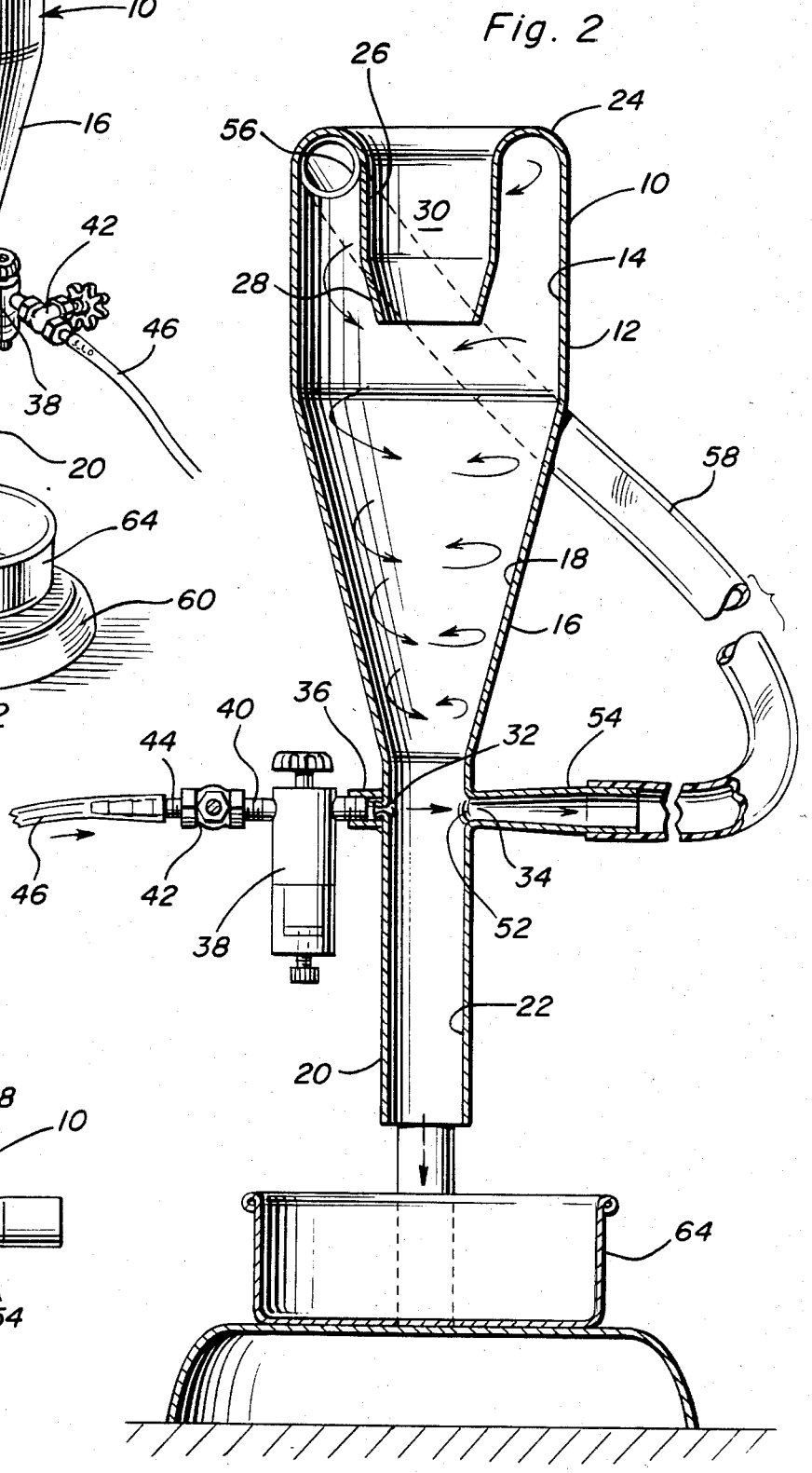
FIG. 2 is a fragmentary enlarged vertical sectional view taken substantially upon the plane indicated by the section line 2—2 of FIG. 1.
Figure 3:
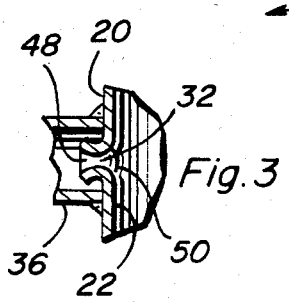
FIG. 3 is an enlarged fragmentary vertical sectional view illustrating the structure of the seed dehull at the point of entrance of compressed air into the dehuller.
Figure 4:
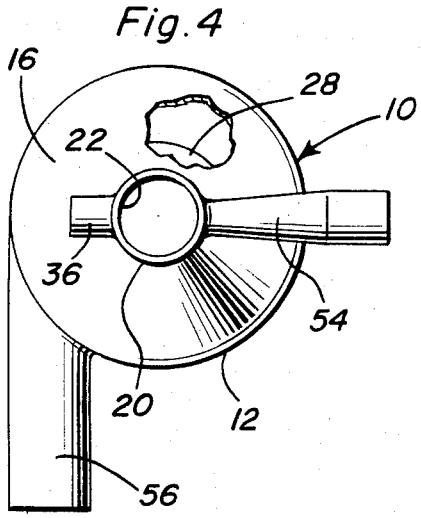
FIG. 4 is a bottom plan view of the seed dehuller with a lower wall portion thereof being broken away.

Referring now more specifically to the drawings the numeral 10 generally designates the seed dehuller of the instant invention. The dehuller 10 comprises a cyclone separator including an upper portion 12 defining an upright cylindrical chamber 14, an intermediate portion 16 defining an inverted frusto-conical chamber 18 and a lower portion 20 defining a cylindrical passage 22. The lower end of the chamber 14 merges smoothly into the upper major diameter end of the chamber 18 and the lower end of the chamber 18 merges smoothly into the upper end of the cylindrical passage 22, the latter being of an inside diameter appreciably smaller than the inside diameter of the cylindrical chamber 14.

The upper end of the cyclone separator includes an annular top wall 24 which closes the outer peripheral portion of the cylindrical chamber 14 from above and the inner periphery of the annular top wall 24 dependingly supports a cylindrical vortex finder 26 which projects downwardly into the chamber 14 and is beveled inwardly as at 28 at its lower end to throttle the interior passage 30 defined within the vortex finder. The lower end of the vortex finder 26 terminates downwardly a spaced distance above the lower end of the cylindrical chamber 14 which merges into the upper end of the chamber 18.

The cylindrical passage 22 includes a generally radially inwardly opening compressed air inlet 32 a spaced distance below the upper end of the cylindrical passage 22 which opens into the lower end of the chamber 18 and a lateral airflow outlet 34 which opens outwardly in a radial direction and is substantially diametrically opposite the inlet 32. The inlet 32 includes an internally threaded fitting 36 operatively associated therewith by which a pressure indicating filter 38 is supported for discharging of air under pressure therefrom to the inlet 32 and the filter 38 includes a compressed air inlet 40 with which a manual control valve 42 is communicated. The control valve 42 includes an inlet fitting 44 to which the discharge end 46 of a compressed air line may be connected.

The inlet 32 is axially short and includes an inwardly tapering inlet end 48 and a flared outlet end 50. Further, the outlet 34 is inwardly flared as at 52 and includes a gradually outwardly flaring fitting 54 extending outwardly from the outlet 34. The upper portion of the chamber 14 includes a tangential re-circulatory air inlet 56 opening thereinto between one wall portion of the vortex finder and the opposing wall portion of the cylindrical chamber 14 and a hose 58 communicates the fitting 54 with the inlet 56.

The cyclone separator 10 is supported above a base 60 by a standard 62 and the base 60 is generally centered beneath the lower end of the lower portion 20 and may support a seed sample cup 64 therefrom.

The above referred to specific dimensions of the separator 10 may of course may according to the specific type of seed to being dehulled.

The throttled lower end 28 of the vortex finder 26 is substantially $1\frac{3}{4}$ inches in inside diameter, the vortex finder 26 extends downwardly from the top wall approximately $3\frac{1}{2}$ inches and the height of the cylindrical chamber 14 is approximately 4 inches. The total height of the separator 10 is approximately $17\frac{1}{2}$ inches and the vertical extent of the cylindrical passage 22 from the inlet 32 to the lower end of the passage 22 is approximately 5 inches. Further, the cylindrical passage 22 is approximately $1\frac{1}{4}$ inches in diameter, the inlet 32 is approximately 3/32 inch in diameter and the outlet 34 is approximately $\frac{1}{2}$ inch in diameter and gradually increases toward the outlet end of the fitting 54 to an inside diameter of approximately one inch. Also, the included angle of the chamber 18 is approximately 30°.

In operation, a five gram sample of seed to be dehulled and subsequently tested is placed within the tray 64 and compressed air is allowed to flow inwardly through the inlet 32 from the filter 38 at a predetermined high pressure. This high pressure inflow of air transversely of the upper end of the cylindrical passage 22 creates a negative pressure within the lower end of the cylindrical passage 22 and the tray containing the seed sample may be moved upwardly beneath the lower end of the lower portion 20 in order that the entire five gram sample may be sucked up into the cylindrical passage 22 and acted upon by the high speed jet of air being discharged from the inlet 32, diametrically across the upper end of the cylindrical passage 22 and into the outlet 34. This high pressure air serves to dehull the seed and the air dehulled seed and partially dehulled seed is then discharged from the fitting 54 into the tube 58 and subsequently discharged into the upper portion of the chamber 14 through the inlet 56. The cyclonic action upon the seed within the separator 10 causes the chaff and other light materials as well as substantially all of the dust, dehulled and partially dehulled seeds to move downwardly through the chamber 18 to again be acted upon by the diametric jet of compressed air being discharged from the inlet 32 across the passage 22 and into the outlet 34 whereupon any partially dehulled seed is further dehulled and the dehulled seed and any remaining partially dehulled seed is again recirculated to the top of the chamber 14 through the hose 58. This operation is repeated very quickly and after a period of only five to ten seconds the dehulling operation is complete with substantially clean air, only, being discharged upwardly through the vortex finder 26. After a five to ten second operating time the air pressure is reduced and the heavier dehulled seed falls downwardly through the cylindrical passage 22 and out the lower end thereof whereby the dehulled seed may be collected in an appropriate pan provided therefor on the base 60. Thereafter, the pan of dehulled seed is removed and a further pan is placed on the base 60 beneath the lower portion 20 and the air pressure is further reduced and subsequently terminated whereby the chaff and other light contaminants will fall downwardly from the cyclone separator 10 through the passage 22 and be collected in the second tray. In this manner, both the dehulled seed as well as the chaff and other contaminants may be carefully inspected.

In view of the relative simplicity of the cyclone separator 10 and its quick mode of operation in dehulling and separating seed and hulls of a small five gram sample, the operating efficiency of seed processing machinery may be tested during a seed processing run to increase the efficiency of the overall seed processing run, a more accurate testing of seed and field testing of seed preparatory to and during a seed reaping operation may be carried out, all to the advantage of a seed grower.

The seed dehuller may be transformed into a continuous production seed dehuller merely by slightly reducing the pressure of air supplied thereto and continuously supplying seed to be dehulled downwardly through a vertical delivery tube (not shown) projecting downwardly through the interior passage 30 to a point spaced slightly below the lower end of the vortex finder 26, such tube being loosely downwardly received through the passage 30.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A seed dehuller including an upper upright cylindrical chamber, a central inverted frusto-conical chamber including major and minor diameter upper and lower ends and a lower depending cylindrical passage, the lower end of said upper chamber merging downwardly into the upper major diameter end of said inverted frusto-conical chamber, said minor diameter lower end merging downwardly into said passage, said passage being of smaller diameter than the diameter of said cylindrical chamber, an annular top wall closing the outer periphery of the upper end of the cylindrical chamber and including an inner periphery of smaller diameter than the diameter of said cylindrical chamber, a tubular votrex finder opening and extending downwardly into said cylindrical chamber from the inner periphery of said top wall, said cylindrical passage including a small diameter generally radially inwardly opening compressed air inlet intermediate the upper and lower ends of said passage and a lateral airflow outlet of greater cross-sectional area than said inlet opening generally radially outwardly of said cylindrical passage substantially diametrically opposite said inlet, said cylindrical chamber including an upper substantially tangential air inlet, and passage means communicating said lateral airflow outlet with said tangential inlet, said small diameter compressed air inlet including means adapted for connection with a variable pressure source of air under pressure.

2. The dehuller of claim 1 wherein said top wall is downwardly concave in radial cross section.

3. The dehuller of claim 1 wherein the lower end of said tubular vortex finder is inwardly tapered to define a "choked" or restricted lower open end thereof.

4. The dehuller of claim 3 wherein said vortex finder lower end is spaced above the level at which the cylindrical chamber merges downwardly into the upper major diameter end of the inverted frusto-conical chamber.

5. The dehuller of claim 1 wherein the inner extremity of said lateral airflow outlet is inwardly flared and the outer inlet portion and inner outlet portion of said small diameter compressed air inlet are flared.

6. The dehuller of claim 1 wherein the inside diameter of said vortex finder is approximately one-half the inside diameter of said cylindrical chamber.

7. The dehuller of claim 1 wherein said conical chamber defines an included angle of approximately 30° and is of a length approximately one and one-third times the maximum diameter of said inverted frusto-conical chamber.

8. The dehuller of claim 7 wherein the diameter of said cylindrical passage is approximately 10–15 times the diameter of said compressed air inlet and approximately two and one-half times the diameter of said lateral airflow outlet.

* * * * *